US005551736A

United States Patent [19]

Fann et al.

[11] Patent Number: 5,551,736

[45] Date of Patent: Sep. 3, 1996

[54] DUAL BACKSET DEADBOLT ASSEMBLY FOR A CYLINDER LOCK

[75] Inventors: Yaw-Shin Fann, deceased, late of Chia-Yi, by Fan Fing Ting, legal representative; Ching-Chuan Kuo, Chia-Yi Hsien; Ming-Shyang Chiou, Chia-Yi, all of Taiwan

[73] Assignee: Tong-Lung Metal Industry Co., Ltd., Taiwan

[21] Appl. No.: 225,145

[22] Filed: Apr. 8, 1994

[30] Foreign Application Priority Data

Mar. 25, 1994 [CN] China ..... 94 1 03424.0

[51] Int. Cl.[6] ..... E05C 19/00

[52] U.S. Cl. ..... 292/1.5; 292/336.3

[58] Field of Search ..... 70/461; 292/1.5, 292/336.3

[56] References Cited

U.S. PATENT DOCUMENTS

| | | | |
|---|---|---|---|
| Re. 34,240 | 5/1993 | Lin | 292/337 |
| 4,615,549 | 10/1986 | Couture | 292/337 |
| 4,750,766 | 6/1988 | Shen | 292/337 |
| 4,890,871 | 1/1990 | Lin | 292/1.5 |
| 4,927,199 | 5/1990 | Wu | 292/1.5 |
| 5,074,605 | 12/1991 | Fann et al. | 292/337 |
| 5,102,175 | 4/1992 | Wu et al. | 292/337 |
| 5,169,184 | 12/1992 | Bishop | 292/1.5 |
| 5,257,837 | 11/1993 | Bishop | 292/1.5 |
| 5,257,838 | 11/1993 | Lin | 292/1.5 |
| 5,354,109 | 10/1994 | Lin | 292/1.5 |

*Primary Examiner*—Steven N. Meyers
*Assistant Examiner*—Gary Estremsky
*Attorney, Agent, or Firm*—Ladas & Parry

[57] ABSTRACT

Two first engagement members are formed on a first side of a transmission plate of a dual backset deadbolt assembly, while two second engagement members are formed on an opposite second side of the transmission plate posterior to the first engagement members. A first cam drive unit is retained rotatably in a first backset position relative to the transmission plate and is disposed adjacent to the first side. A second cam drive unit is movable between first and second backset positions relative to the transmission plate and is disposed adjacent to the second side. A deadbolt operating spindle of a lock extends through the first and second cam drive units so as to permit engagement of the first cam drive unit with one of the first engagement members in order to actuate the transmission plate when the second cam drive unit is in the first backset position and the deadbolt assembly is adjusted to a shorter backset length. The deadbolt operating spindle extends through the second cam drive unit so as to permit engagement of the second cam drive unit with one of the second engagement members in order to actuate the transmission plate when the second cam drive unit is in the second backset position and the deadbolt assembly is adjusted to a longer backset length.

5 Claims, 5 Drawing Sheets

DUAL BACKSET DEADBOLT ASSEMBLY FOR A CYLINDER LOCK

BACKGROUND OF THE INVENTION

1. Field of the Invention

The invention relates to a cylinder lock, more particularly to a dual backset deadbolt assembly for a cylinder lock.

2. Description of the Related Art

Referring to FIG. 1, a deadbolt assembly 7 is installed operatively within a deadbolt hole 91 formed in one edge of a door panel 9. Screws 75 are used to mount a face plate 72 of the deadbolt assembly 7 on the door panel 9. A lock body 8 is installed in a lock hole 92 formed in the door panel 9 and transverse to the axis of the deadbolt hole 91. The lock body 8 has a deadbolt operating spindle 81 and a pair of internally threaded hollow fasteners 82 which extend respectively through a drive unit 74 and a pair of fastener holes 73 of the deadbolt assembly 7. When the lock body 8 is rotated, the spindle 81 rotates so as to actuate the driving unit of the deadbolt assembly 7, thereby retracting the deadbolt 71 into the deadbolt housing 76.

The distance between the edge of the door panel 9 and the axis of the lock hole 92 is known as the backset. Presently, there are two commonly used standard backset lengths, namely 2⅜ inches (60 mm) and 2¾ inches (70 mm). Deadbolt assemblies which are adjustable between the two standard backset lengths have been disclosed in U.S. Pat. Nos. 4,615,549, 4,750,766, 5,074,605, 5,102,175 and Re.34, 240. The conventional deadbolt assemblies, however, are inconvenient to install. For example, U.S. Pat. No. Re.34, 240 discloses a deadbolt assembly with spaced first and second pairs of engagement members formed on one side of a transmission plate thereof. A cam drive unit of the deadbolt assembly is movable between a longer backset position, wherein the cam drive unit is rotatable so as to engage the first pair of engagement members, and a shorter backset position, wherein the cam drive unit is rotatable so as to engage the second pair of engagement members. It is noted that a slight rotation of the cam drive unit when moved from the longer backset position to the shorter backset position can result in untimely engagement between the cam drive unit and the first pair of engagement members, thereby preventing adjustment of the backset length of the deadbolt assembly to result in inconvenience during installation.

SUMMARY OF THE INVENTION

Therefore, the objective of the present invention is to provide a dual backset deadbolt assembly which utilizes a novel transmission means that facilitates adjustments between the two standard backset lengths.

Accordingly, the dual backset deadbolt assembly of the present invention is to be used in a lock with a deadbolt operating spindle and is adjustable between shorter and longer backset lengths. The deadbolt assembly comprises a deadbolt housing, a deadbolt mounted in the deadbolt housing and movable between an extended position and a retracted position relative to the front end of the deadbolt housing, and an extension housing extending from the rear end of the deadbolt housing and including two parallel side plates which are connected to one another so as to confine a chamber. Each of the side plates has a longitudinal axis and first and second backset holes formed along the longitudinal axis. The second backset hole is posterior to the first backset hole. An auxiliary mounting plate extends into the chamber of the extension housing and is formed with a mounting hole. A transmission plate has a front engaging end that is connected to the deadbolt, and a rear forked portion that extends into the chamber of the extension housing and that includes a pair of spaced strips and an oblong opening formed between the strips and aligned with the first and second backset holes of the side plates. Each of the strips has a first side formed with a first engagement member, and an opposite second side formed with a second engagement member that is posterior to the first engagement member. A first cam drive unit is retained rotatably within the first backset hole of one of the side plates and is disposed adjacent to the first side of the strips. The first cam drive unit is formed with a spindle engaging hole and has a pair of cam elements for actuating the first engagement members of the strips. A second cam drive unit is retained rotatably within the mounting hole of the mounting plate and is disposed adjacent to the second side of the strips. The second cam drive unit is formed with a spindle engaging hole and has a pair of cam elements for actuating the second engagement members of the strips. The second cam drive unit is movable relative to the extension housing between first and second backset positions.

The spindle engaging hole of the second cam drive unit is aligned with that of the first cam drive unit and the first backset holes of the side plates when the second cam drive unit is in the first backset position, thereby permitting extension of the deadbolt operating spindle through the spindle engaging holes of the first and second cam drive units so as to rotate the first cam drive unit therewith in order to actuate the transmission plate when the deadbolt assembly is adjusted to the shorter backset length. The second cam drive unit is aligned with the second backset holes of the side plates when the second cam drive unit is in the second backset position, thereby permitting extension of the deadbolt operating spindle through the spindle engaging hole of the second cam drive unit so as to rotate the second cam drive unit therewith in order to actuate the transmission plate when the deadbolt assembly is adjusted to the longer backset length.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 2:
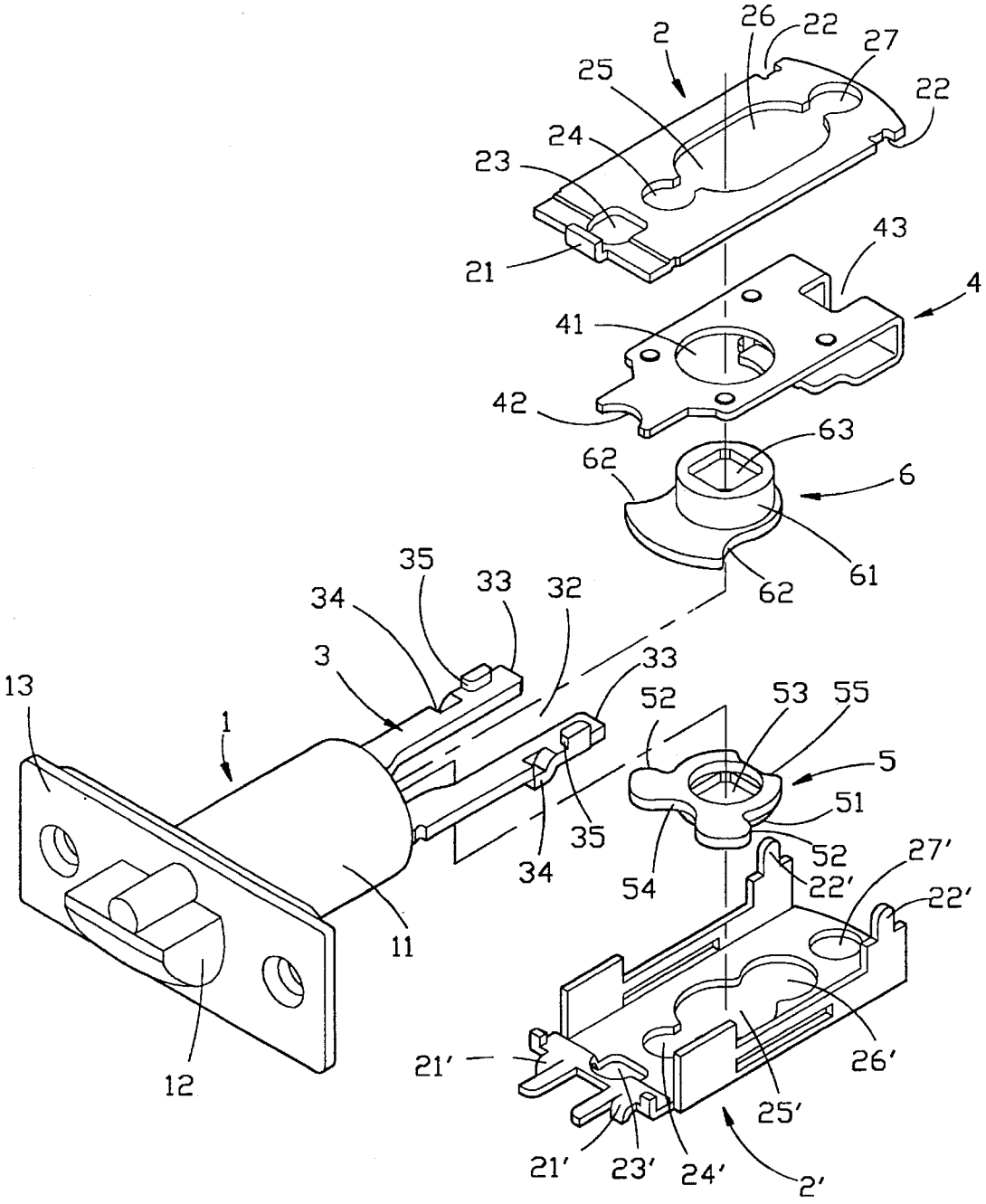
FIG. 2 is an exploded view of the preferred embodiment of a dual backset deadbolt assembly according to the present invention.
Figure 3:
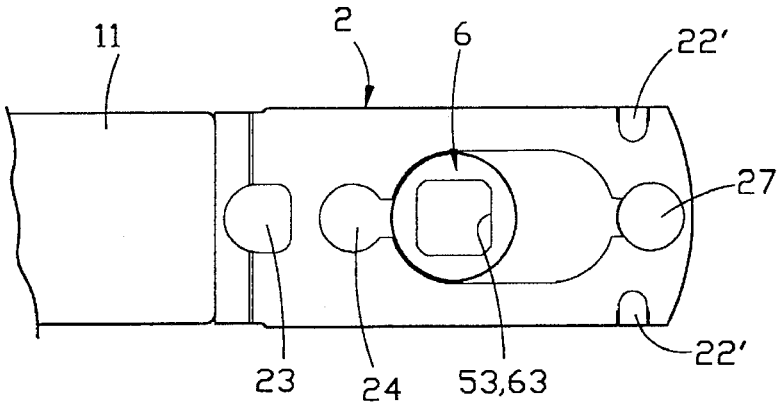
FIG. 3 is a top view of the preferred embodiment when adjusted to the shorter backset length.
Figure 4:
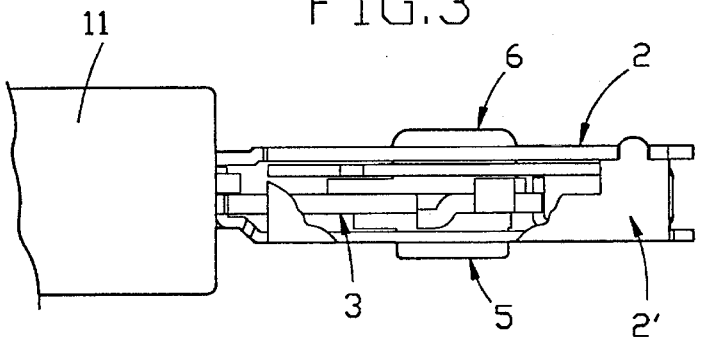
FIG. 4 is a side view of the preferred embodiment when adjusted to the shorter backset length.
Figure 5:
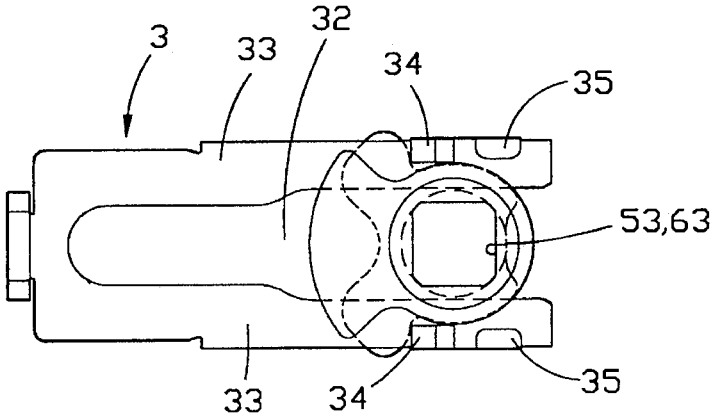
FIG. 5 is a top view which illustrates the relative positions of a transmission plate and first and second cam drive units of the preferred embodiment when the preferred embodiment is adjusted to the shorter backset length.
Figure 6:
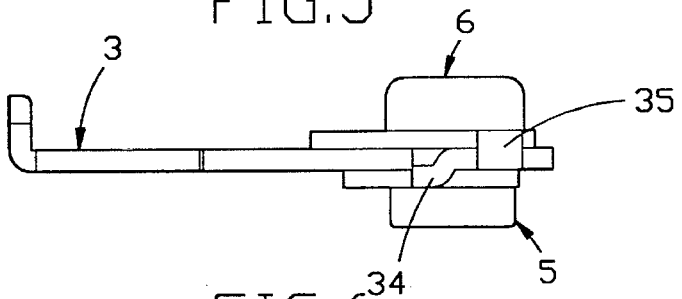
FIG. 6 is a side view which illustrates the relative positions of the transmission plate and the first and second cam drive units when the preferred embodiment is adjusted to the shorter backset length.

Referring to FIG. 2, the preferred embodiment of a dual backset deadbolt assembly according to the present invention is shown to comprise a deadbolt housing 11 and a deadbolt 12 mounted in the housing 11. Since the construction of the deadbolt 12 is known in the art, the details thereof will not be described hereinafter. The deadbolt housing 11 has a front end with a face plate 13 provided thereat. The face plate 13 is adapted to be mounted on the edge of a door panel in a conventional manner.

An extension housing extends from a rear end of the deadbolt housing 11 and includes parallel side plates 2, 2' which are connected to one another so as to confine a chamber. Each of the side plates 2, 2' has a fastening portion 21, 21' which is formed at a front end and which extends into the deadbolt housing 11 so as to be secured thereto. The side plate 2' has opposite longitudinal edges formed with a respective tongue 22' that extends toward and engages the side plate 2 via corresponding notches 22 in the latter. Each of the side plates 2, 2' is formed with five through holes, namely, a first fastener hole 23, 23', a second fastener hole 24, 24' posterior to the first fastener hole 23, 23', a first backset hole 25, 25' posterior to the second fastener hole 24, 24', a second backset hole 26, 26' posterior to the first backset hole 25, 25', and a third fastener hole 27, 27' posterior to the second backset hole 26, 26'. The first and second backset holes 25, 26 of the side plate 2 are confined within an elongated opening. The chamber confined by the side plates 2, 2' accommodates the following elements: a transmission plate 3, an auxiliary mounting plate 4, a first cam drive unit 5 and a second cam drive unit 6.

Figure 1:
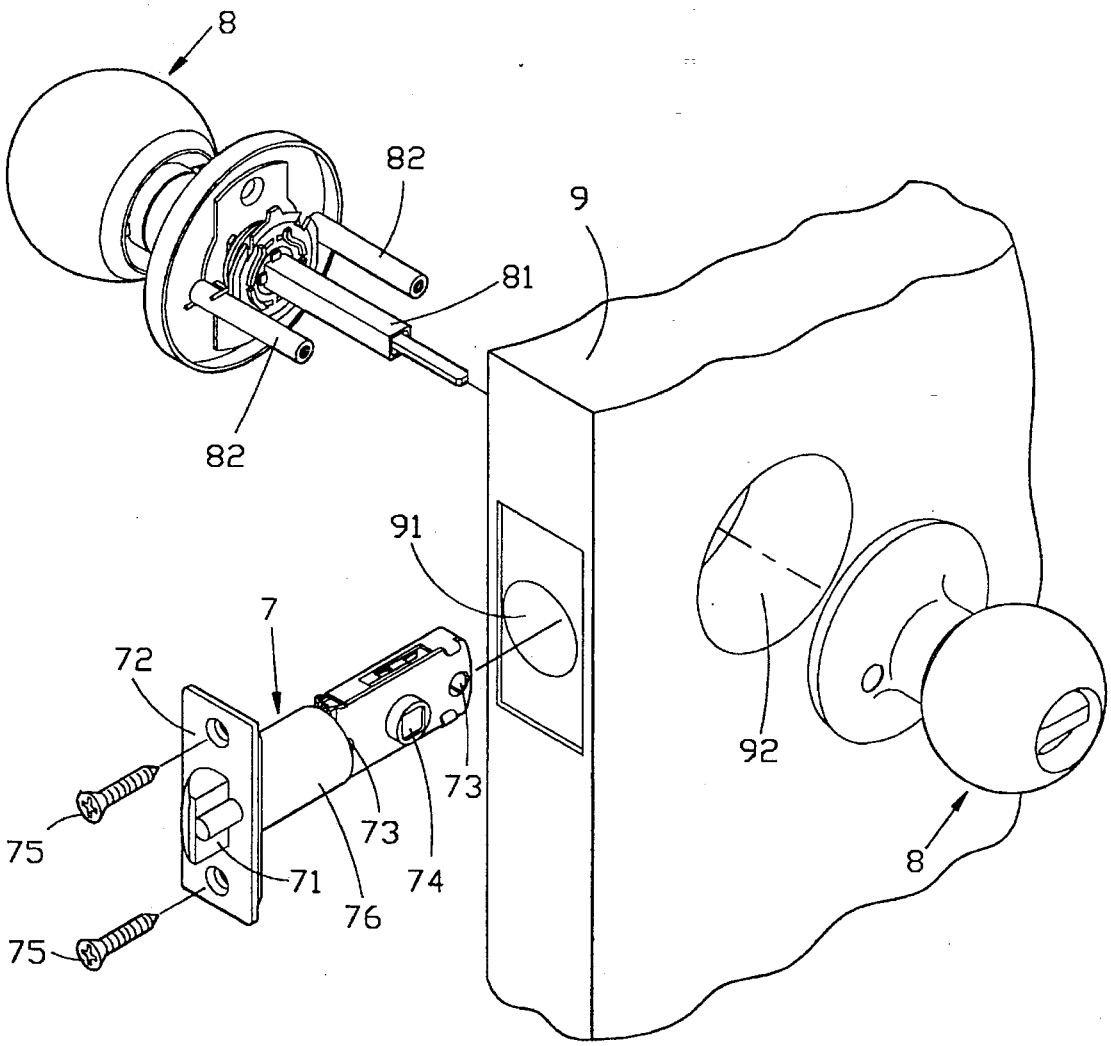
FIG.1 PRIOR ART
FIG. 1 is an exploded view which illustrates how a door lock and a deadbolt assembly are mounted conventionally on a door panel.

The auxiliary mounting plate 4 extends between the side plates 2, 2' via the rear end of the extension housing and has a first fastener notch 42 at a front end, a folded rear portion which is formed with a second fastener notch 43, and a hole 41 to permit mounting of the second cam drive unit 6 rotatably thereat. The folded rear portion of the auxiliary mounting plate 4 engages resiliently and slidably inner surfaces of the side plates 2, 2'. The first and second fastener notches 42, 43 permit extension of a respective fastener of the conventional lock body (see FIG. 1) therethrough. After the deadbolt assembly of the present invention has been adjusted to the desired backset length and has been installed on the door panel, the mounting plate 4 cooperates with the fasteners of the lock body to retain the deadbolt assembly securely on the door panel.

The transmission plate 3 extends between the side plates 2, 2' via the front end of the extension housing and has a front engaging end that extends into the deadbolt housing 11 and that is connected to the deadbolt 12 in a known manner. The transmission plate 3 further has a rear forked portion which includes a pair of spaced strips 33 and an oblong opening 32 formed between the strips 33. The strips 33 are formed with a pair of aligned first engagement members 34 on a first side, and a pair of aligned second engagement members 35 on an opposite second side. The second engagement members 35 are posterior to the first engagement members 34. The first cam drive unit 5 operably engages the first engagement members 34 when the backset length is set to 60 mm., while the second cam drive unit 6 operably engages the second engagement members 35 when the backset length is set to 70 mm.

The first cam drive unit 5 includes a cylindrical body 51 which is retained rotatably within the first backset hole 25' of the side plate 2' and which is disposed adjacent to the first side of the strips 33. The cylindrical body 51 is formed with a spindle engaging hole 53 through which the deadbolt operating spindle of the conventional lock body is adapted to extend and has a pair of cam elements 52 which extend radially therefrom. The first cam drive unit 5 further has a first notch 54 formed between the cam elements 52 and a second notch 55 opposite to the first notch 54. When the backset length is set to 70 mm., the first notch 54 permits extension of one of the fasteners of the lock body therethrough, while the second notch 55 permits extension of a part of the deadbolt operating spindle therethrough. Thus, the first cam drive unit 5 does not hinder rotation of the spindle when the backset length is set to 70 mm.

The second cam drive unit 6 includes a cylindrical body 61 which is retained rotatably within the hole 41 of the mounting plate 4 and is disposed adjacent to the second side of the strips 33. The cylindrical body 61 extends into the elongated opening of the side plate 2. When adjusting the backset length of the deadbolt assembly of the present invention, the cylindrical body 61 is moved to extend into a corresponding one of the first and second backset holes 25, 26. Like the first cam drive unit 5, the cylindrical body 61 is formed with a spindle engaging hole 63 through which the deadbolt operating spindle of the conventional lock body is adapted to extend and has a pair of cam elements 62 which extend radially therefrom.

Referring to FIGS. 2 to 6, the second cam drive unit 6 is moved so as to locate the cylindrical body 61 of the second cam drive unit 6 in the first backset hole 25 when the backset length is set to 60 mm. The second cam drive unit 6 is aligned with the first cam drive unit 5 at this stage. The deadbolt operating spindle of the lock body extends through the spindle engaging holes 53, 63 of the first and second cam drive unit 5, 6, and the fasteners of the conventional lock body extend respectively through the first and third fastener holes 23, 23', 27, 27' of the side plates 2, 2'.

Figure 7:
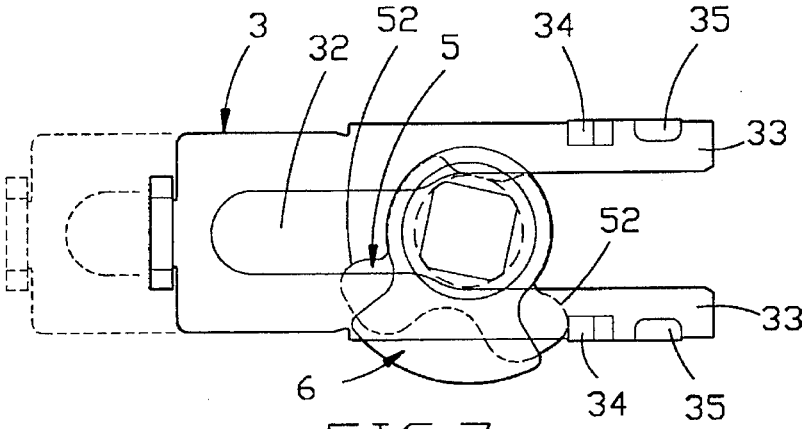
FIG. 7 is a top view which illustrates how the first cam drive unit actuates the transmission plate.
Figure 8:
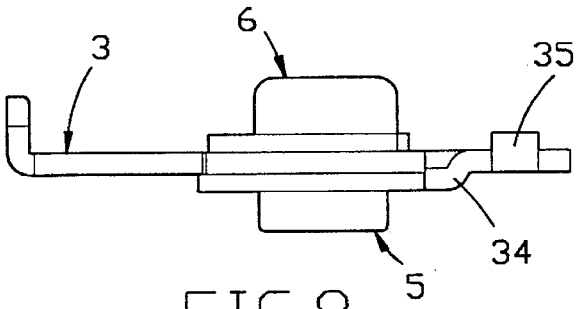
FIG. 8 is a side view which illustrates how the first cam drive unit actuates the transmission plate.
Figure 9:
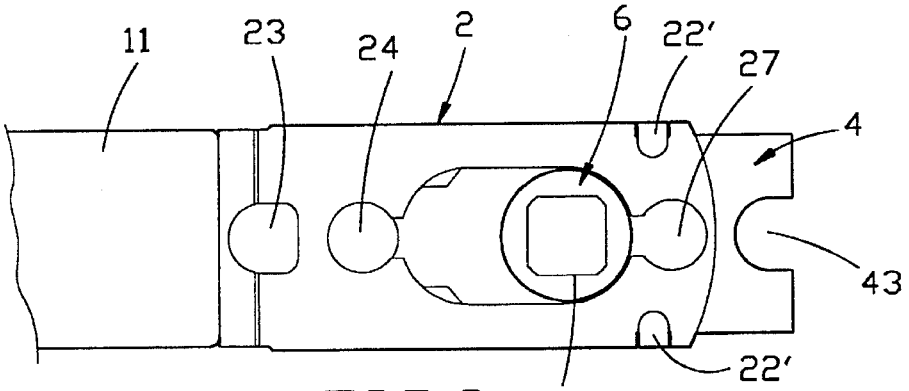
FIG. 9 is a top view of the preferred embodiment when adjusted to the longer backset length.
Figure 10:
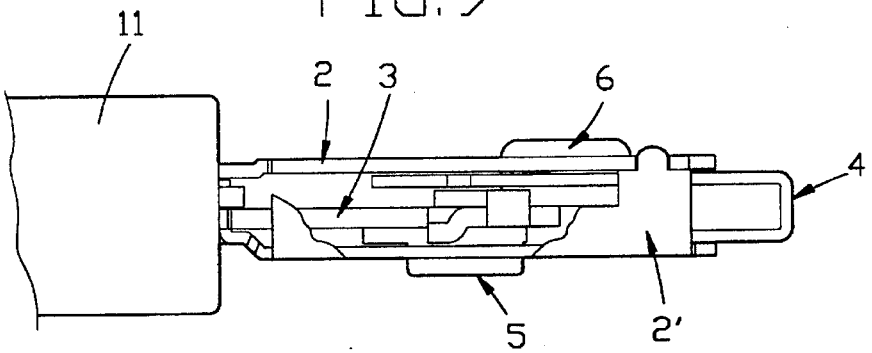
FIG. 10 is a side view of the preferred embodiment when adjusted to the longer backset length.
Figure 11:
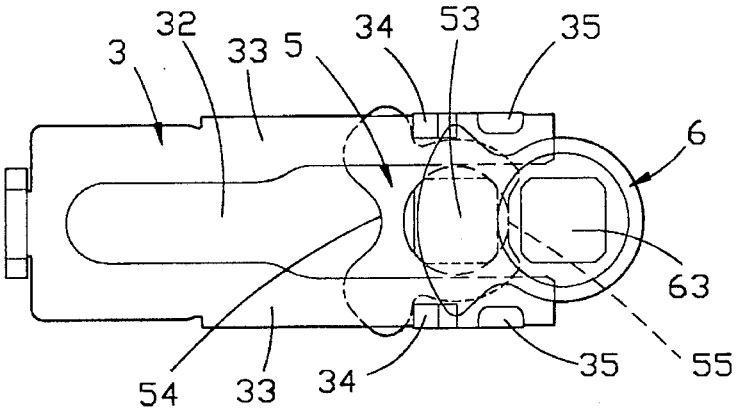
FIG. 11 is a top view which illustrates the relative positions of the transmission plate and the first and second cam drive units when the preferred embodiment is adjusted to the longer backset length.
Figure 12:
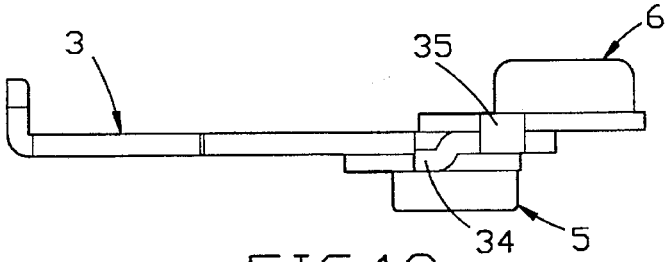
FIG. 12 is a side view which illustrates the relative positions of the transmission plate and the first and second cam drive units when the preferred embodiment is adjusted to the longer backset length.

Referring to FIGS. 7 and 8, when the spindle of the conventional lock body rotates, the first and second cam drive units 5, 6 rotate therewith, thereby causing one of the cam elements 52 of the first cam drive unit 5 to engage the first engagement member 34 on one of the strips 33 of the transmission plate 3 in order to actuate the latter and retract the deadbolt 12 into the housing 11. The second cam drive unit 6 does not engage any part of the transmission plate 3 at this time.

Referring to FIG. 2 and to FIGS. 9 to 12, the second cam drive unit 6 is moved so as to locate the cylindrical body 61 in the second backset hole 26 when the backset length is set to 70 mm. The tail end of the mounting plate 4 extends out of the extension housing, while the second cam drive unit 6 is posterior to the first cam drive unit 5. The deadbolt operating spindle of the lock body extends through the spindle engaging hole 63 of the second cam drive unit 6 and has a part which extends through the second notch 55 of the first cam drive unit 5 at this stage. A first one of the fasteners of the conventional lock body extends through the second fastener holes 24, 24' of the side plates 2, 2' and the first notch 54 of the first cam drive unit 5, while a second one of the fasteners extends through the second fastener notch 43 of the mounting plate 4.

Figure 13:
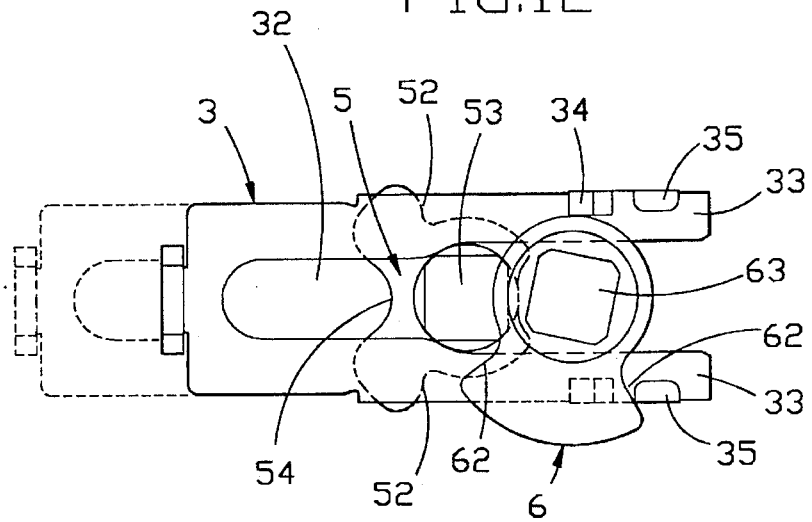
FIG. 13 is a top view which illustrates how the second cam drive unit actuates the transmission plate.
Figure 14:
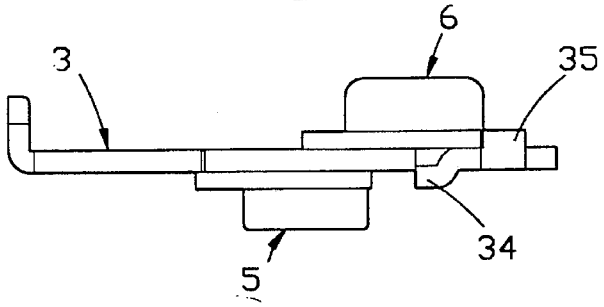
FIG. 14 is a side view which illustrates how the second cam drive unit actuates the transmission plate.

Referring to FIGS. 13 and 14, when the spindle of the conventional lock body rotates, the second cam drive unit 6 rotates therewith, thereby causing one of the cam elements 62 of the second cam drive unit 6 to engage the second engagement member 35 on one of the strips 33 of the transmission plate 3 in order to actuate the latter and retract the deadbolt 12 into the housing 11. The first cam drive unit 5 does not rotate at this time.

It is noted that adjustment of the deadbolt assembly to the desired backset length is convenient to achieve because the first engagement members 34 do not hinder movement of the second cam drive unit 6 relative to the extension housing, thereby facilitating its installation. The objective of the present invention is thus achieved.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

We claim:

1. A dual backset deadbolt assembly for a lock with a deadbolt operating spindle, said deadbolt assembly being adjustable between shorter and longer backset lengths and comprising:

a deadbolt housing having a front end and a rear end;

a deadbolt mounted in said deadbolt housing and movable between an extended position and a retracted position relative to said front end of said deadbolt housing;

an extension housing extending from said rear end of said deadbolt housing and including two parallel side plates which are connected to one another so as to confine a chamber, each of said side plates having a longitudinal axis and first and second backset holes formed along said longitudinal axis, said second backset hole being posterior to said first backset hole;

an auxiliary mounting plate extending into said chamber of said extension housing and formed with a mounting hole;

a transmission plate having a front engaging end that is connected to said deadbolt, and a rear forked portion that extends into said chamber of said extension housing and that includes a pair of spaced strips and an oblong opening formed between said strips and aligned with said first and second backset holes of said side plates, each of said strips having a first side formed with a first engagement member, and an opposite second side formed with a second engagement member, said second engagement member being posterior to said first engagement member;

a first cam drive unit retained rotatably within said first backset hole of one of said side plates and disposed adjacent to said first side of said strips, said first cam drive unit being formed with a spindle engaging hole and having a pair of cam elements for actuating said first engagement members of said strips; and a second cam drive unit retained rotatably within said mounting hole of said mounting plate and disposed adjacent to said second side of said strips, said second cam drive unit being formed with a spindle engaging hole and having a pair of cam elements for actuating said second engagement members of said strips, said second cam drive unit being movable relative to said extension housing between first and second backset positions;

said spindle engaging hole of said second cam drive unit being aligned with that of said first cam drive unit being aligned with that of said first cam drive unit and said first backset holes of said side plates when said second cam drive unit is in said first backset position, thereby permitting extension of the deadbolt operating spindle through said spindle engaging holes of said first and second cam drive units so as to rotate said first cam drive unit therewith in order to actuate said first engagement members of said strips of said transmission plate when said deadbolt assembly is adjusted to the shorter backset length;

said second cam drive unit being aligned with said second backset holes of said side plates when said second cam drive unit is in said second backset position, thereby permitting extension of the deadbolt operating spindle through said spindle engaging hole of the second cam drive unit so as to rotate said second cam drive unit therewith in order to actuate said second engagement members of said strips of said transmission plate when said deadbolt assembly is adjusted to the longer backset length.

2. The dual backset deadbolt assembly as claimed in claim 1, wherein each of said side plates is further formed a first fastener hole, a second fastener hole posterior to said first fastener hole and anterior to said first and second backset holes, and a third fastener hole posterior to said second backset hole.

3. The dual backset deadbolt assembly as claimed in claim 2, wherein said first and second backset holes of the other one of said side plates are confined within an elongated opening.

4. The dual backset deadbolt assembly as claimed in claim 3, wherein:

said first cam drive unit has a cylindrical body retained rotatably within said first backset hole of said one of said side plates; and said second cam drive unit has a cylindrical body which is retained rotatably within said mounting hole of said mounting plate and which extends into said elongated opening of the other one of said side plates.

5. The dual backset deadbolt assembly as claimed in claim 4, wherein said mounting plate has a folded rear portion which is formed with a fastener notch and which engages resiliently and slidably inner surfaces of said side plates.

* * * * *